US005723831A

United States Patent [19]

Martin et al.

[11] Patent Number: 5,723,831

[45] Date of Patent: Mar. 3, 1998

[54] TACKABLE ACOUSTICAL BARRIER PANEL

[75] Inventors: David B. Martin, Jenison; Henry A. Thenikl, Grand Rapids; Jerry L. Davis, Rockford; Tim M. Poel; John Vanderkolk, both of Hudsonville, all of Mich.

[73] Assignee: Herman Miller Inc., Zeeland, Mich.

[21] Appl. No.: 802,180

[22] Filed: Feb. 18, 1997

Related U.S. Application Data

[63] Continuation of Ser. No. 360,146, Dec. 20, 1994, abandoned.

[51] Int. Cl.[6] ..... E04B 1/343

[52] U.S. Cl. ..... 181/287; 181/290; 52/145

[58] Field of Search ..... 181/284, 286, 181/287, 288, 290, 291, 292, 294, 295; 52/144, 145

[56] References Cited

U.S. PATENT DOCUMENTS

| | | |
|---|---|---|
| 2,328,618 | 9/1943 | Corso . |
| 2,887,173 | 5/1959 | Boshi . |
| 3,021,916 | 2/1962 | Kemp . |
| 3,151,712 | 10/1964 | Jackson . |
| 3,166,149 | 1/1965 | Hulse et al. . |
| 3,200,734 | 8/1965 | Burns et al. . |
| 3,211,253 | 10/1965 | Gonzalez . |
| 3,380,206 | 4/1968 | Barnett . |
| 3,497,029 | 2/1970 | Stark . |
| 3,819,007 | 6/1974 | Wirt et al. . |
| 3,821,999 | 7/1974 | Guess et al. . |
| 3,822,762 | 7/1974 | Crispin et al. . |
| 3,831,710 | 8/1974 | Wirt . |
| 3,834,487 | 9/1974 | Hale . |
| 3,887,031 | 6/1975 | Wirt . |
| 3,910,374 | 10/1975 | Holehouse . |
| 3,948,346 | 4/1976 | Schindler . |
| 4,001,473 | 1/1977 | Cook . |
| 4,021,973 | 5/1977 | Hegg et al. . |
| 4,084,366 | 4/1978 | Saylor et al. . |
| 4,084,367 | 4/1978 | Saylor et al. . |
| 4,155,211 | 5/1979 | Saylor et al. . |
| 4,189,027 | 2/1980 | Dean, III et al. . |
| 4,231,447 | 11/1980 | Chapman . |
| 4,235,303 | 11/1980 | Dhoore et al. . |
| 4,241,806 | 12/1980 | Metzger . |
| 4,248,325 | 2/1981 | Georgopoulos ..... 181/284 |
| 4,254,171 | 3/1981 | Beggs et al. . |
| 4,265,955 | 5/1981 | Harp et al. . |
| 4,269,882 | 5/1981 | Carrillo et al. . |
| 4,291,079 | 9/1981 | Hom . |
| 4,291,080 | 9/1981 | Ely et al. . |
| 4,292,356 | 9/1981 | Whitemore et al. . |
| 4,294,329 | 10/1981 | Rose et al. . |
| 4,298,090 | 11/1981 | Chapman . |
| 4,300,978 | 11/1981 | Whitemore et al. . |
| 4,318,453 | 3/1982 | Rose et al. . |

(List continued on next page.)

FOREIGN PATENT DOCUMENTS

| | | |
|---|---|---|
| 0 006 707 | 6/1979 | European Pat. Off. . |
| 0 027 001 | 9/1980 | European Pat. Off. . |
| 86106340 | 11/1986 | European Pat. Off. . |
| 0 375 641 | 11/1989 | European Pat. Off. . |
| 3903966 A1 | 8/1990 | Germany . |

*Primary Examiner*—Khanh Dang
*Attorney, Agent, or Firm*—Brinks Hofer Gilson & Lione

[57] ABSTRACT

The invention is directed to a tackable/acoustical wall panel having a peripheral frame including a top rail, a bottom rail, opposed side rails and a dividing rail bisecting the panel into a first cavity and a second cavity. The dividing rail extends at a height where a work surface would be attached to the panel. The first cavity has a substantially rigid first septum mounted therein in order to restrict sound transmission through the panel. The first septum has opposing rigid front and back surfaces. A tackable inner layer is secured to the first septum. The second cavity has a substantially rigid second septum mounted therein in order to restrict sound transmission through the panel. The second septum has opposing rigid front and back surfaces. A decorative cover is secured to the frame and extends over the first cavity and the second cavity.

20 Claims, 2 Drawing Sheets

U.S. PATENT DOCUMENTS

| | | | |
|---|---|---|---|
| 4,379,191 | 4/1983 | Beggs et al. . | |
| 4,384,020 | 5/1983 | Beggs et al. . | |
| 4,384,634 | 5/1983 | Shuttleworth et al. . | |
| 4,410,065 | 10/1983 | Harvey . | |
| 4,421,811 | 12/1983 | Rose et al. . | |
| 4,433,021 | 2/1984 | Riel . | |
| 4,465,725 | 8/1984 | Riel . | |
| 4,475,624 | 10/1984 | Bourland, Jr. et al. . | |
| 4,509,616 | 4/1985 | Blecherman . | |
| 4,522,284 | 6/1985 | Fearon et al. . | |
| 4,522,859 | 6/1985 | Blair . | |
| 4,539,244 | 9/1985 | Beggs et al. . | |
| 4,539,245 | 9/1985 | Sarin et al. . | |
| 4,571,906 | 2/1986 | Ashton . | |
| 4,627,199 | 12/1986 | Capaul . | |
| 4,630,416 | 12/1986 | Lapins et al. | 181/290 X |
| 4,641,726 | 2/1987 | Fearon . | |
| 4,671,841 | 6/1987 | Stephens . | |
| 4,719,730 | 1/1988 | Winkowski . | |
| 4,990,391 | 2/1991 | Veta et al. . | |
| 5,009,043 | 4/1991 | Kurrasch | 181/290 X |
| 5,022,943 | 6/1991 | Zaima . | |
| 5,041,323 | 8/1991 | Rose . | |
| 5,086,606 | 2/1992 | Rinses . | |
| 5,151,311 | 9/1992 | Parente . | |
| 5,172,530 | 12/1992 | Fishel . | |
| 5,423,151 | 6/1995 | Caro et al. | 181/290 X |

TACKABLE ACOUSTICAL BARRIER PANEL

This application is a continuation of application Ser. No. 08/360,146, filed Dec. 20, 1994 now abandoned.

BACKGROUND OF THE INVENTION

The present invention relates generally to space dividing panels of the open-office plan type. More particularly, the invention relates to a wall panel that can serve as a tackable surface and has excellent sound absorptive and barrier characteristics.

Office space is often rented as a large open space area generally without partitions. Normally such office space is divided into a number of smaller, more functional work stations by utilizing semi-permanent panels of varying height in the form of metal frames joined together at their edges and having a covered core. Integral bulletin boards or tackable surfaces have become an important feature in many space dividing wall systems. In addition, given the open nature of many office spaces, the acoustical properties of a panel are also important. In particular, a significant amount of noise is created in the typical office environment by the movement of people in adjacent areas, the use of telephones, the operation of business equipment and normal business activities in general. Accordingly, it is important that these panels have sound absorptive and barrier properties so that noise within the office may be controlled in order to create a more productive work place.

Unfortunately, preferred acoustical properties and the ability to maintain performance as a tackable panel over long periods of time are often incompatible characteristics. Most tackable boards provide poor sound absorbing characteristics because they are relatively hard and will reflect incident sound waves back into the work area. For example, mineral boards or cork surfaces are well suited to receive tack-type pins with little destruction to the material through repeated use. However, these surfaces are a poor sound absorptive material and reflect a large percentage of the sound waves directed at them. In fact, a cork surface can produce a reflective sound wave almost equal in intensity to that of the incident wave.

Other tackable materials have been used with somewhat better results. For example, a low-density fiberglass material has been used as a tackable material. While a high-density fiberglass achieves good results as a tackable material and as a sound absorptive material, this tackable material has been shown to lack the durability to withstand repeated use below a work surface where it is subject to collision. Accordingly, while a high-density fiberglass is useful above an associated work surface where the tackable property is necessary, extending this tackable material beneath the work surface adds unnecessarily to the overall expense of the panel. In addition, the somewhat brittle nature of the material may allow for the panel to be damaged if subject to a sufficient force. For example, if a user accidentally kicked the lower portion of the panel, the tackable material could be easily broken. As a result, there is a need for a more cost efficient panel having excellent sound absorbing and barrier properties while also having a tackable nature.

SUMMARY OF THE INVENTION

This invention is directed to a tackable/acoustical wall panel having a peripheral frame including a top rail, a bottom rail, opposed side rails and a dividing rail bisecting the panel into a first cavity and a second cavity. The dividing rail extends at a height where a work surface would be attached to the panel. The first cavity has a substantially rigid first septum mounted therein in order to restrict sound transmission through the panel. The first septum has opposing rigid from and back surfaces. A tackable inner layer is secured to the first septum. The second cavity has a substantially rigid second septum mounted therein in order to restrict sound transmission through the panel. The second septum has opposing rigid front and back surfaces. A decorative cover is secured to the frame and extends over the first cavity and the second cavity.

In a preferred embodiment of the invention, a fire-resistant foil layer is interposed between the decorative cover and the frame, the first cavity and the second cavity.

The present invention, together with attendant objects and advantages, will be best understood with reference to the detailed description below, read in conjunction with the accompanying drawings.

DETAILED DESCRIPTION OF THE PREFERRED EMBODIMENTS

Figure 1:
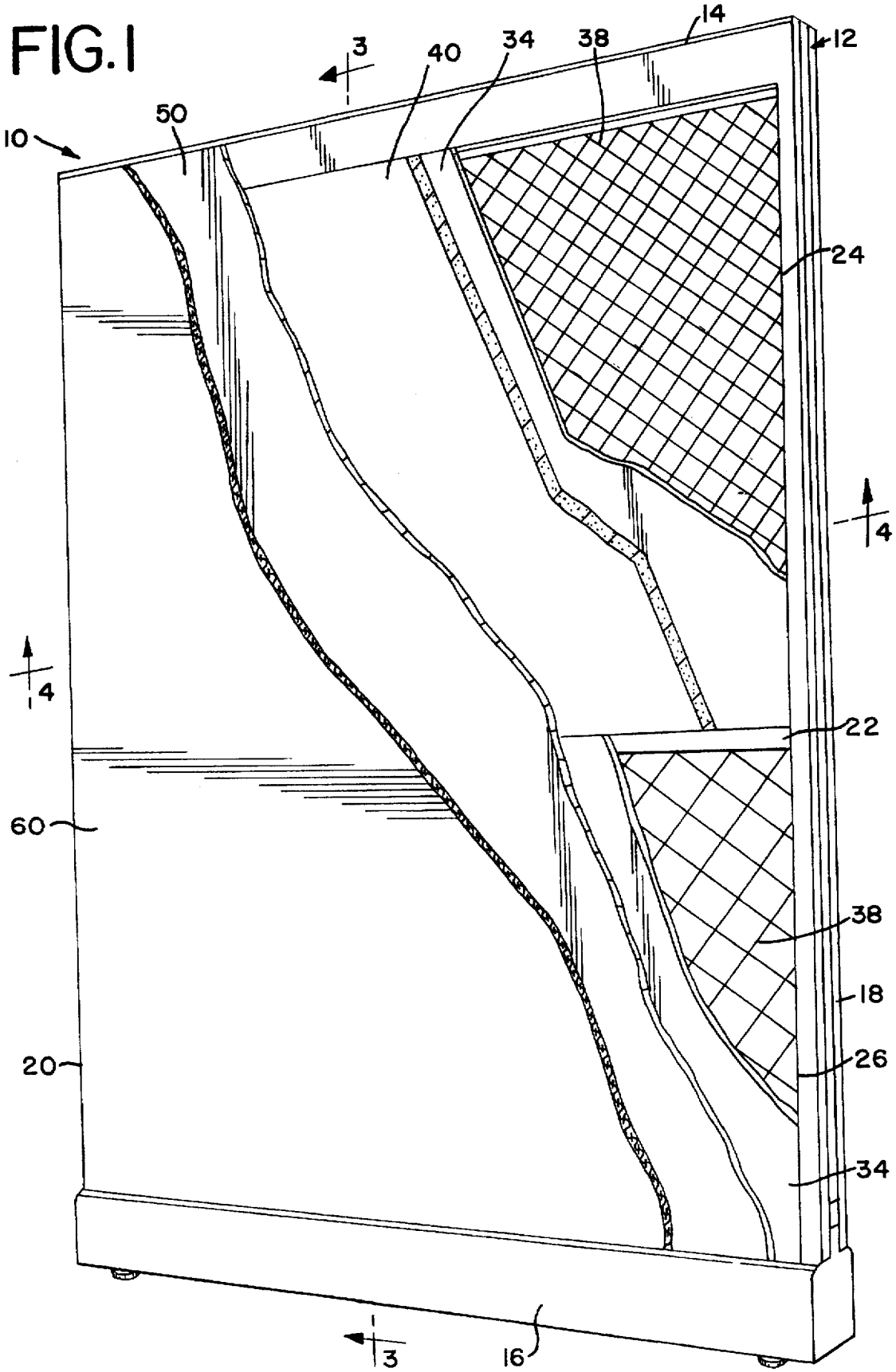
FIG. 1 is a perspective view of the tackable acoustical-barrier wall panel of the present invention shown partially broken away.
Figure 2:
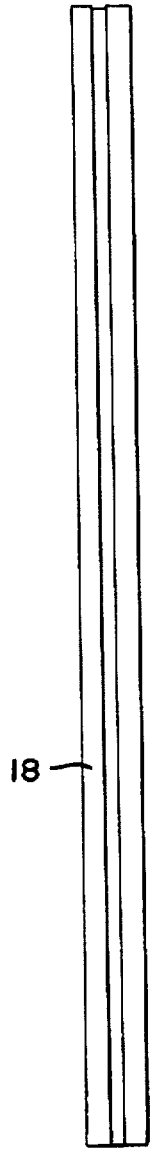
FIG. 2 is a side view of the present invention.

Referring to FIG. 1, a tackable acoustical-barrier panel 10 formed in accordance with the present invention is shown. The panel 10 is adapted for use as a wall panel or partition in a modular office furniture system of the open plan type wherein the panel in conjunction with other panels of like construction, subdivide an otherwise large open area into smaller, more functional work spaces. However, it should be understood that panel 10 could be used in many devices having a wall, such as a cabinet. It should also be understood that the panel 10 may be manufactured in a wide variety of heights and lengths in order to suit the needs of a particular user.

Figure 3:
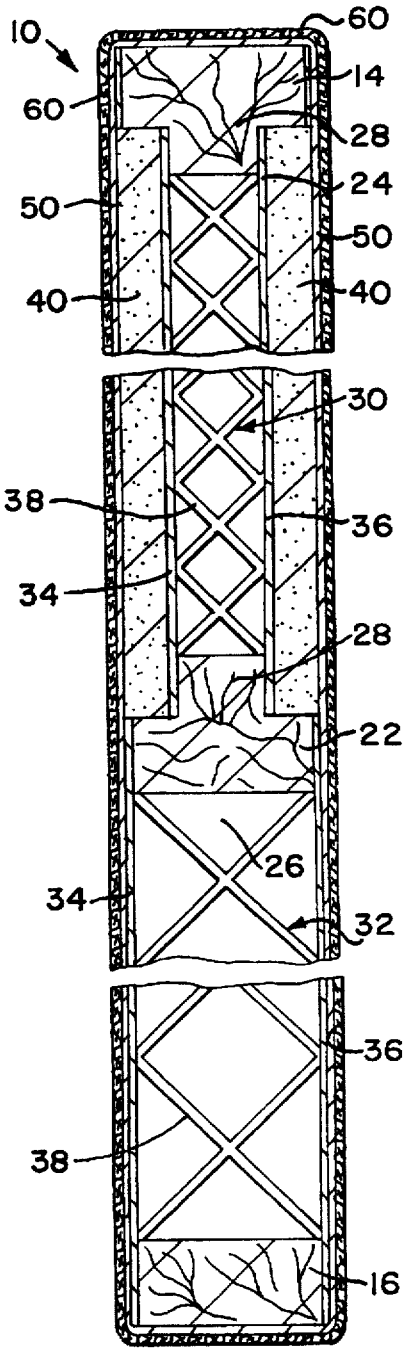
FIG. 3 is a cross-sectional view of the present invention taken along the lines 3—3 of FIG. 1.
Figure 4:
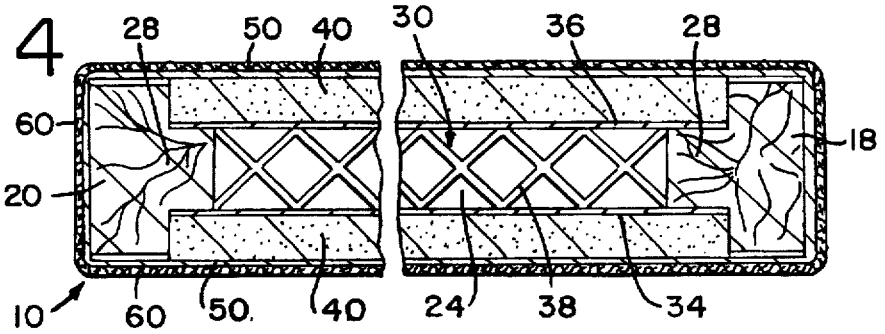
FIG. 4 is a cross-sectional view of the present invention taken along the lines 4—4 of FIG. 1.

The panel 10 includes a frame 12 having a top rail 14, a bottom rail 16, two side rails 18 and 20 and a dividing rail 22. The frame 12 forms a generally rectangular structure with the dividing rail 22 forming a first cavity 24 above the dividing rail 22 and a second cavity 26 below the dividing rail 22. The dividing rail 22 is generally positioned at a height where a work surface would be attached to the panel 10. As shown in FIGS. 3 and 4, the hat-shaped ribs 28 project into the first cavity 24 from the top rail 14, the two side rails 18 and 20 and the dividing rail 22. The ribs 28 project into the second cavity 26 from the two side rails 18 and 20 (not shown). The ribs 28 preferably has a width of approximately ¾" and a projects into the first cavity 24 and the second cavity 26 approximately ½".

The various frame members 14, 16, 18, 20 and 22 are preferably formed from 1¾" particle board or other similar materials such as wood fiber composite materials. The materials used should be capable of securely receiving mechanical fasteners such as staples or the like for securing materials to the frame 12. The frame 12 may be formed by securing the rails 14, 16, 18, 20 and 22 together through a suitable fastening technique such as an adhesive material. Preferably, an adhesive such as casein should be used in combination with a cold pressing process to form the frame 12, although other adhesives such as a hot melt could be used. Casein is available through the National Casein Company of Chicago, Ill. under Part No. 8580.

Mounted within the first cavity 24 and the second cavity 26 respectively are a first septum 30 and a second septum 32. The frame 12 in combination with the septums 30 and 32 provides suitable structural rigidity to reliably function as an office partition from which office components may be hung. The septums 30, 32 fit tightly within the frame 12 through the use of an adhesive material or appropriate fastening mechanism. Again, an adhesive such as casein is preferred although other known adhesives may be used. It is important that the septums 30, 32 be securely positioned within the frame 12 and form a tight seal with ribs 28 in order to prevent any sound leaks.

The septums 30, 32 are preferably formed from a material commonly known as "stressed shim" which comprises hardboard front and rear surfaces 34, 36 having a honeycomb material 38 made from corrugated paper commonly known as "dore core" interposed therebetween. The front and rear surfaces 34, 36 have a thickness of approximately 1/10". The septum 30 for the first cavity 24 preferably has an overall thickness of approximately 1" and the septum 32 for the second cavity 26 preferably has an overall thickness of approximately 1¾". Accordingly, the first septum 30 has a width substantially equal to that of the ribs 28 and the second septum 32 has a width substantially equal to that of the bottom rail 16 and the dividing rail 22. In some larger panels a stronger first septum 30 may be necessary in the first cavity 24. Accordingly, the first septum 30 may be alternately made from opposing aluminum surfaces with a high pressure laminate bonded therebetween.

A tackable inner layer 40 is bonded through the use of an adhesive to the opposing surfaces 34, 36 of the first septum 30. Each tackable layer 40 is preferably in the form of a fiberglass panel having a thickness of approximately ⅜". In this embodiment, the fiberglass has a density of 11 lbs./ft.$^3$ An example of a suitable fiberglass is available from Michigan Molded Acoustics in Hudson, Mich. under Part No. 169686. A high density fiberglass is preferred because it has sufficient strength to support a tack and a work item therein while also being a durable material capable of withstanding long term use for this purpose. However, it should be recognized that a wide range of fiberglass materials having varying densities could also be used. In addition, mineral fiber boards or other fibrous wood materials could also be used. The tackable inner layer 40 is bonded to the first septum 30 through the use of a hot melt adhesive. A suitable hot melt adhesive may be purchased from H. B. Fuller of Palatine, Ill. under Part No. HL-7216.

A fire-resistant foil layer 50 overlies the frame 12 including the first cavity 24 and the second cavity 26. The foil layer 50 is preferably formed from a thin layer of metal, such as aluminum, having a tear-resistant fiberglass backing laminated thereto. Suitable materials can be obtained from Lydel, Inc. of Troy, N.Y. under Part No. 1207-F. The foil layer 50 is mounted to the frame 12 to improve the fire retardancy of the panel 10. The thickness of the foil layer is approximately 5 thousandths of an inch.

The foil layer 50 is significant in that it provides a fire protective barrier for the frame 12, the septums 30, 32 and the tackable inner layer 40 yet also allows sound energy to be transmitted therethrough so that it can be absorbed within the panel 10. The fiberglass backing on the foil layer 50 provides a measure of heat insulation and also provides for improved sound absorbing capabilities. In addition, it has been found that small perforations in the foil layer 50 on the order of 3/100" and positioned every quarter of an inch in a square grid pattern provides the panel with improved sound absorbing properties. The foil layer 50 can be secured to the frame 12 through the use of a variety of well known fastening mechanisms. Preferably, the foil layer 50 is secured to the frame 12 together with the decorative cover 60.

The panel 10 can be finished by the addition of a decorative cover or outer layer 60. A wide variety fabric materials known to those of ordinary skill in the art may be chosen depending of the needs of a particular user. The decorative outer layer 60 is secured to the frame 12 through the use of staples, adhesive materials or other known fastening mechanisms.

The embodiments described above are illustrative and not restrictive. The scope of the invention is indicated by the claims rather than by the foregoing description. The invention may be embodied in other specific forms without departing from the spirit of the invention. Accordingly, all changes which come within the scope of the claims are intended to be embraced therein. For example, the present invention can be used for walls of various shapes and sizes.

We claim:

1. A tackable/acoustical wall panel comprising:

a peripheral frame having a top rail, a bottom rail, opposed side rails and a dividing rail, the dividing rail separating the panel into a first cavity and a second cavity, the first cavity having a substantially rigid first septum mounted therein in order to restrict sound transmission through the panel, the first septum having opposing rigid front and back surfaces, a tackable inner layer secured to the first septum, the second cavity having a substantially rigid second septum mounted therein in order to restrict sound transmission through the panel, the second septum having opposing rigid front and back surfaces, wherein said second septum is isolated from any tackable material, and a decorative cover secured to the frame and extending over the first cavity and the second cavity.

2. The tackable/acoustical wall panel of claim 1 wherein the first cavity is at height greater than that of the second cavity.

3. The tackable/acoustical wall panel of claim 1 further comprising a fire-resistant foil layer interposed between the decorative cover and the frame, the foil layer covering the frame, the first cavity and the second cavity.

4. The tackable/acoustical wall panel of claim 3 wherein the tackable inner layer is formed from a fiberglass material.

5. The tackable/acoustical wall panel of claim 4 wherein the fiberglass material has a density of 11 lbs./ft.$^3$.

6. The tackable/acoustical wall panel of claim 4 wherein the first septum and the second septum are formed from a honeycomb material interposed between a hard board front surface and a hardboard rear surface.

7. The tackable/acoustical wall panel of claim 6 wherein the foil layer comprises aluminum foil.

8. The tackable/acoustical wall panel of claim 7 wherein the foil layer has small spaced apart perforations located therein.

9. A tackable/acoustical wall panel comprising:

a peripheral frame having a top rail, a bottom rail, opposed side rails and a dividing rail, the dividing rail separating the frame into a first cavity and a second cavity, the top rail having a downwardly directed hat-shaped rib and the dividing rail having an upwardly directed hat-shaped rib, the first cavity having a substantially rigid first septum mounted to the ribs of the top rail and dividing rail in order to restrict sound transmission through the panel, the first septum having opposing front and back surfaces, a tackable inner layer secured to the first septum, the second cavity having a substantially rigid second septum mounted therein in order to restrict sound transmission through the panel, the second septum having opposing front and back surfaces, and a decorative cover secured to the frame and extending over the first cavity and the second cavity.

10. The tackable/acoustical wall panel of claim 9 wherein the side rails have a rib extending downward from the top rail.

11. The tackable/acoustical wall panel of claim 10 wherein the first cavity is at a height greater than that of the second cavity.

12. The tackable/acoustical wall panel of claim 11 further comprising a foil layer interposed between the decorative cover and the frame, the first cavity and the second cavity, the foil layer covering the frame, the first cavity and the second cavity.

13. The tackable/acoustical wall panel of claim 12 wherein the foil layer comprises aluminum foil.

14. The tackable/acoustical wall panel of claim 13 wherein the tackable inner layer is formed from a fiberglass material.

15. The tackable/acoustical wall panel of claim 14 wherein the first septum and the second septum are formed from a paper honeycomb material interposed between a hard board front surface and a hardboard rear surface.

16. The tackable/acoustical wall panel of claim 15 wherein the peripheral frame is made from a pressed particle board.

17. The tackable/acoustical wall panel of claim 16 wherein the first septum and second septum are bonded to the the top rail, the bottom rail, the side rails and the dividing rail through the use of an adhesive.

18. A tackable/acoustical wall panel comprising:

a peripheral frame having a top rail, a bottom rail, opposed side rails and a dividing rail bisecting the frame into a first cavity and a second cavity, the top rail having a downwardly directed hat-shaped rib and the dividing rail having an upwardly directed hat-shaped rib, the first cavity having a substantially rigid first septum mounted to the ribs of the top rail and dividing rail in order to restrict sound transmission through the panel, the first septum having opposing front and back surfaces and a width substantially equal to that of the rib, a tackable inner layer secured to the first septum, the second cavity having a substantially rigid second septum mounted therein in order to restrict sound transmission through the panel, the second septum having opposing front and back surfaces, the second septum having a width substantially equal to that of the bottom rail and the dividing rail, a decorative cover secured to the frame and extending over the first cavity and the second cavity.

19. The tackable/acoustical wall panel of claim 18 wherein the first septum is bonded to the ribs of the top, side and dividing rails.

20. The tackable/acoustical wall panel of claim 19 wherein the first septum and the second septum are bonded to the frame through the use of an adhesive.

* * * * *